US009013360B1

(12) United States Patent
Apostolos et al.

(10) Patent No.: US 9,013,360 B1
(45) Date of Patent: Apr. 21, 2015

(54) CONTINUOUS BAND ANTENNA (CBA) WITH SWITCHABLE QUADRANT BEAMS AND SELECTABLE POLARIZATION

(75) Inventors: John T. Apostolos, Lyndeborough, NH (US); Judy Feng, Nashua, NH (US); William Mouyos, Windham, NH (US)

(73) Assignee: AMI Research & Development, LLC, Windham, NH (US)

( * ) Notice: Subject to any disclaimer, the term of this patent is extended or adjusted under 35 U.S.C. 154(b) by 355 days.

(21) Appl. No.: 13/469,222

(22) Filed: May 11, 2012

Related U.S. Application Data

(60) Provisional application No. 61/485,924, filed on May 13, 2011.

(51) Int. Cl.
*H01Q 9/16* (2006.01)
*H01Q 9/06* (2006.01)

(52) U.S. Cl.
CPC ..... *H01Q 9/06* (2013.01)

(58) Field of Classification Search
USPC ..... 343/793, 797, 876, 893
See application file for complete search history.

(56) References Cited

U.S. PATENT DOCUMENTS

| | | | | |
|---|---|---|---|---|
| 4,376,281 | A | 3/1983 | Smith | |
| 4,704,611 | A | 11/1987 | Edwards et al. | |
| 6,104,349 | A * | 8/2000 | Cohen | 343/702 |
| 7,528,789 | B2 | 5/2009 | Gothard et al. | |
| 8,160,530 | B2 | 4/2012 | Corman et al. | |
| 2009/0073049 | A1 * | 3/2009 | Apostolos | 343/700 MS |
| 2009/0096691 | A1 * | 4/2009 | Apostolos | 343/742 |
| 2010/0259346 | A1 | 10/2010 | Runyon | |
| 2010/0260076 | A1 | 10/2010 | Corman et al. | |
| 2010/0283699 | A1 | 11/2010 | Apostolos et al. | |
| 2012/0154236 | A1 | 6/2012 | Apostolos et al. | |
| 2012/0280872 | A1 * | 11/2012 | Werner et al. | 343/753 |
| 2013/0257680 | A1 * | 10/2013 | Nix et al. | 343/876 |

* cited by examiner

*Primary Examiner* — Tan Ho
(74) *Attorney, Agent, or Firm* — Cesari and McKenna, LLP

(57) ABSTRACT

An antenna formed from one or more structures with sets of radiating elements oriented in four different, preferably orthogonal, directions. The radiating elements are further provided as multiple horizontal and vertical radiating section. The structure may be a six sided cube-like structure or a cylinder. A combining circuit provides omnidirectional, directional, and scanning/direction finding modes across a broad operating frequency range with multiple polarizations. The arrangement lends itself to implementation as a whip form factor well suited for vehicular applications.

16 Claims, 12 Drawing Sheets

CONTINUOUS BAND ANTENNA (CBA) WITH SWITCHABLE QUADRANT BEAMS AND SELECTABLE POLARIZATION

CROSS REFERENCE TO RELATED APPLICATION(S)

This application claims the benefit of U.S. Provisional Application Ser. No. 61/485,924 filed May 13, 2011 entitled "Continuous Band Antenna (CBA) with Switchable Quadrant Beams and Selectable Polarization from 512 MHz to 6000 MHz", the entire contents of which are hereby incorporated by reference in their entirety.

BACKGROUND

The proliferation of various wireless communication devices and systems has resulted in the need for improved solutions for antennas. This need is particularly acute in installations such as vehicles where space is at a premium, and where for certain applications such as military, police and some commercial installations, it is highly desirable to provide continuous coverage across a wide range of frequencies. While vehicles can employ multiple separate antennas that are individually designed to communicate effectively within a particular frequency band, it is far more convenient a single antenna can provide coverage over a wide range of frequencies.

It is also important to be able to communicate without knowing the relative orientation of the transmit and receive antennas in advance. For example, in the case of communication from a satellite to a terrestrial vehicle, as the vehicle moves about the terrain (or even within a building), signals will arrive at the antenna with a variety of different polarizations from different directions. If the vehicle uses, for example, a simple vertical dipole, one obtains 360° coverage but only for vertically polarized signals. Such a vertical dipole is relatively insensitive to horizontally polarized signals.

Many antennas mounted on vehicles also take the form of a mast that may be purposely flexible so that if the antenna hits an object it will bend and not snap or break. Antennas formed with flexible masts thus have their vertical and/or horizontal orientation direction altered by the flexibility of the mast, meaning that reliable communication cannot always be established if the polarization direction of the antenna is not exactly aligned with that of the transmitter. In short, it is often the case that as the vehicle moves throughout an environment its antenna may tilt at various angles and therefore compromise communications with either a terrestrial base station or a satellite.

One whip style antenna capable of operating in multiple bands was described in United States patent application publication number US 2010/0283699 published on Nov. 11, 2010 entitled "Broadband Whip Antenna". This antenna includes multiple in-line dipole elements, selected ones of which have shielded meander line chokes enable switching from an extended dipole at the lower frequencies to a shortened dipole at the higher frequencies.

SUMMARY

These known antennas are not without shortcomings, however.

For example, there is often a need for providing long range in certain communication bands such as those above 512 MHz up to 6000 MHz. This is due in part to the increase in activity in the frequency bands that carry most Wireless Fidelity (Wi-Fi) traffic such as from 5.5 to 5.7 GHz as well as in the 2.5 to 2.8 GHz band.

In addition it would be desirable to provide multiple operating modes in a single form factor to provide omnidirectional, directional, scanning various polarization modes.

The package should also preferably maintain the desirable whip antenna configuration that is traditionally and easily mounted on vehicles.

Described herein is an antenna formed from one or more three dimensional structures that supports sets of radiating elements. The sets of radiating elements are oriented in four, different, preferably orthogonal, directions. The elements can provide the desired omnidirectional, directional, and polarized modes across a wide frequency range with appropriate combining circuits. The four directional structure can be provided by a cubic structure or can optionally be provided by a cylindrical structure.

Regardless of the external geometry, be it a cube or a cylinder, vertical and horizontal polarization elements are disposed on at least four faces thereof. This vertical polarization elements and two horizontal polarization elements are preferably placed on each face.

A selector module provides connection from horizontal and vertical polarization transmission lines extending from each of the faces to a central location. The selector module contains combining circuits that may be optimally located within the structure to minimize interference. The combining circuit(s) select the desired polarization such as vertical, horizontal, right-hand or left-hand circular, and directional modes.

Directional modes can be further generated by feeding a side facing a desired direction of transmission and shorting the transmission lines from the other three sides. In this mode the other three sides serve as reflecting surfaces. This directional mode has been found to work best in the higher range of frequencies, such as from 1 to 6 GHz.

Circular polarization modes can be generated by feeding the horizontal and vertical elements of the active side with the quadrature hybrid combiner.

An omnidirectional mode can also be provided by feeding all of the elements in phase with one another. This mode can typically work best at midrange frequencies, such as from 512 MHz to 6 GHz. Operations at lower frequencies can be enhanced by insertion of meander line chokes between the vertical polarization elements and at the top and bottom sides.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION OF AN EMBODIMENT

Figure 1:
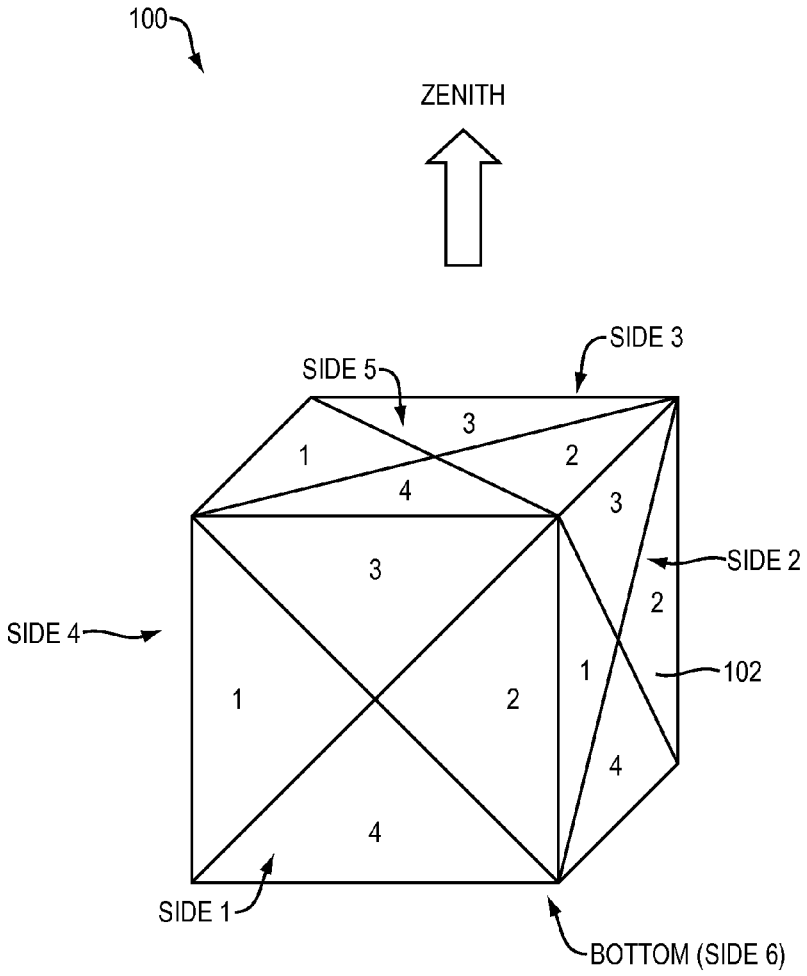
FIG. 1 is a perspective view of a cube structure for supporting antenna elements.

FIG. 1 illustrates an antenna geometry as used in embodiments discussed herein. Here the support structure has six sides. At least four of the sides, such as the four vertically oriented sides, each have four triangular radiating elements 102 disposed thereon. Triangular elements 102 may also be positioned on or formed in at least the top and bottom sides of the six sided structure.

The four triangular radiating elements on each side may be considered to have, for the sake of identification, a horizontal polarization (as indicated by the numbers 1 and 2) and vertical polarization (as numbered 3 and 4). The radiating elements are formed from a conductive material disposed on a dielectric substrate. The substrate also physically isolates the conductive surfaces from one another such that a dielectric gap is formed between and along the corners at the edges of the cube 100. Similarly, a dielectric gap is formed between and along the points at which the triangular elements disposed on each surface lie adjacent each another.

Thus (a detail that is not shown in FIG. 1 but understood) adielectric gap is disposed between element 2 and element 3, between element 3 and element 1, between element 1 and element 4, and between element 4 and element 2.

It should be understood that the reference to element numbers 1, 2, 3 and 4 are meant herein to merely identify particular surfaces and/or antenna elements and are not meant to imply that the structure 100 must be oriented with respect to the terrain in any particular way.

It should also be understood the term "cube" as used here generally refers to structures with six faces, and that all faces of the cube 100 need not be exactly the same size.

Corresponding feed points, not shown in FIG. 1, are associated with each of the triangular elements 102. These feed points are preferably located adjacent a point in the middle of each cube surface, where all four triangular elements come together.

Figure 2:
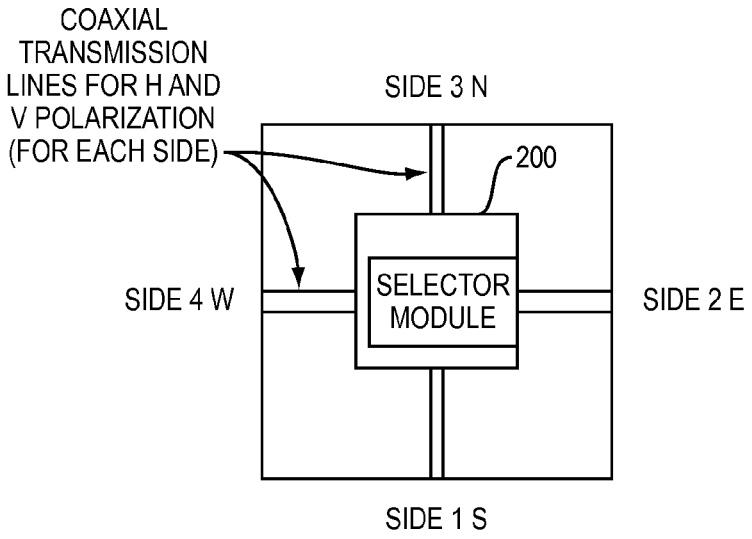
FIG. 2 is a plan view of a selector module located in the middle of the cube.

Referring now to FIG. 2, the feed structure will be described in more detail. A selector module 200 is situated at the interior of the cube 100. The selector module 200 provides connections to a horizontal (H) and vertical (V) polarization transmission line extending from the feed point on each side of the individual elements to the central location at selector module 200. Selector module 200 contains combining circuits that are described in more detail below. Baluns may be inserted in the element feeds to allow coaxial cables to be used as the transmission lines. However, in alternate embodiments the horizontal (H) and vertical (V) polarization transmission lines may be striplines.

As illustrated, each of the four vertically oriented sides of the cube 100 have a coaxial transmission line for the horizontal feed and a separate coaxial transmission line for the vertical polarization feed. Note also that in FIG. 2 the four sides of the cube are labeled with North, East, South, and West (N, E, S, W) better to identify their relative orthogonal orientation. It should be understood, however, that these letters are being used to generally refer to the four faces of the cube 100. In that since the antenna is expected to travel on a vehicle, these labels are not meant to imply that the antenna must be oriented with respect to the terrain in any particular way.

The selector module 200 selects a desired polarization such as vertical, horizontal, right-handed circular or left hand circular and a preferred operating direction (such as N, E, S, W). Elements disposed on a bottom side (side 6 in FIG. 1) typically will not be fed with transmission lines as propagation out to the horizon is a desired mode of operation. This may also be true of elements disposed on the top side.

Directional modes are generated by feeding the side facing the desired direction of transmission and shorting the transmission lines from the other three sides. In this mode, the other three sides serve as reflecting surfaces. Directional modes are typically expected to work best in a frequency range from about 1 through 6 GHz.

Circular polarization modes are generated by feeding the coaxial cables of the active side with a quadrature hybrid circuit. The quadrature hybrid circuit may be implemented as integrated circuit chip, and be configured as described below.

An omnidirectional mode is provided by feeding all of the elements in phase. This mode is typically operational in the frequency range of about 512 MHz or 6 GHz.

Operation below 1 GHz can be enhanced by insertion of meanderline chokes between elements 3 and 4 and between the top and bottom sides respectively. The meander line chokes arranged in this way extend the effective size of the antenna elements in an extended low-frequency operating range. Below 1 GHz, only the omnidirectional vertical polarization is typically used.

Direction finding capability is available by using amplitude distribution as a function of quadrant sector for a particular signal of interest. A processor making this a correlation lookup tables (not shown here) can be used to determine an angle of arrival.

Figure 3B:
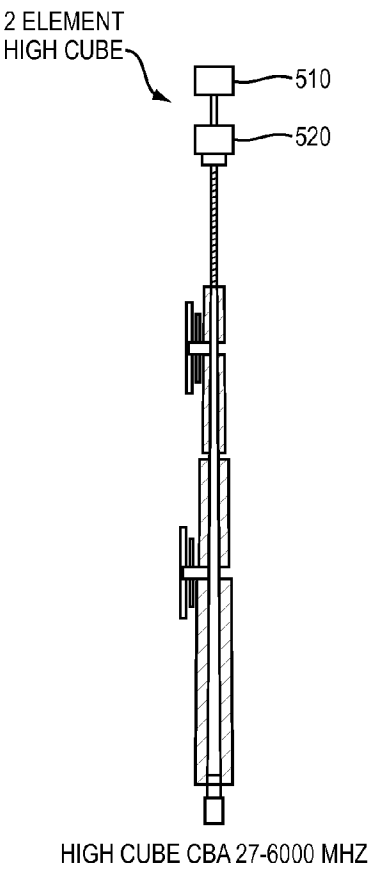
FIG. 3A illustrates a prior art antenna and FIG. 3B illustrates an improved implementation using a stacked pair of "cube" elements.
Figure 3A:
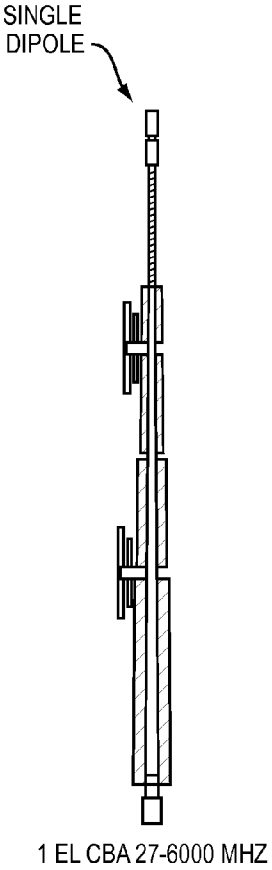
FIG. 3A (PRIOR ART)

The geometry of a Continuous Band Antenna (CBA) of the prior art is shown in FIG. 3A and the improved implementation using the cube structure 100 in FIG. 3B. In this structure are provided to transmission lines feeding two separate collinear dipole structures that are accessible through the base portion of a whip type form factor. The bottom antenna 300 covers for example a range of 27 to 512 MHz, while the top antenna covers a range of for example 512 through 6000 MHz. In the implementation of FIG. 3B, the single dipole is replaced with a pair of cube structures, of FIG. 1, this 510, 520 configuration is referred to as a HIGH cube herein.

It can be appreciated that interaction of the HIGH cube lower dipoles depends on their proximity and any capacitive coupling between them. The distances can be adjusted to optimize coupling between the antenna elements such that some of the energy which would normally be radiated below the horizon is instead reflected into the upper atmosphere.

Figure 4A:
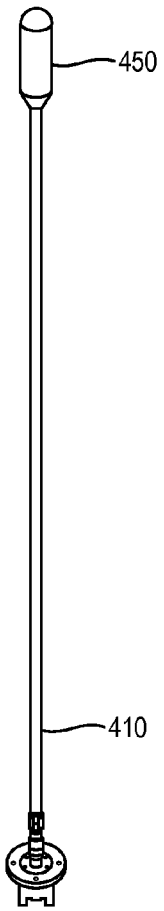
FIGS. 4A, 4B and 4C are a more detailed view of the various components of the HIGH cube implementation of FIG. 3B.
Figure 4B:
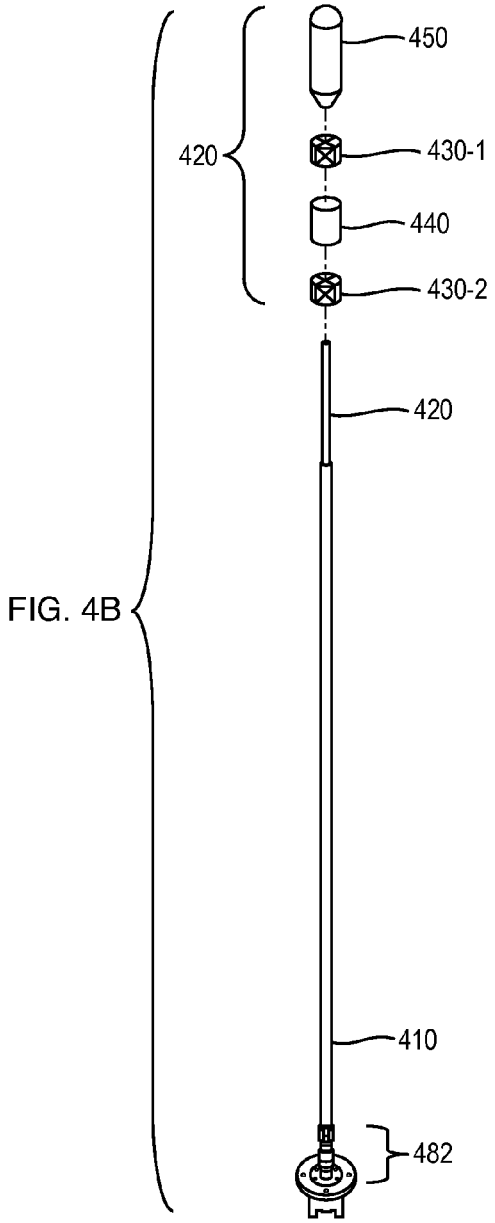
Figure 4C:
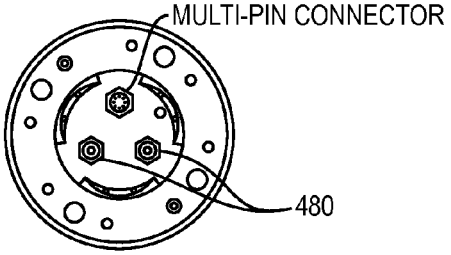

FIGS. 4A, 4B and 4C show the HIGH cube arrangement in more detail. The bottom antenna element 410 is a dipole structure designed to cover a low-frequency range of from for example approximately 27 through 512 MHz. The top antenna elements 420 comprise a pair of HIGH cube elements that cover a frequency range from for example 512 through 6000 MHz. More specifically, HIGH cube section 420 consists of a pair of cubes 430-1, 430-2. A spacer 440 separates the upper element 430-1 and lower element 430-2. It is understood that a radome 450 encloses upper element 430-1, spacer 440 and lower element 430-2.

FIG. 4A is assembled view of the antenna with the radome. FIG. 4B shows these components in an exploded view. FIG. 4C shows a bottom view.

A control line 470 can extend from the lower dipole section 410 which may be a hollow mast. RF connectors are placed in a base portion 482 to provide access to upper element 430-1, lower element 430-2 and dipole 410.

Figure 5B:
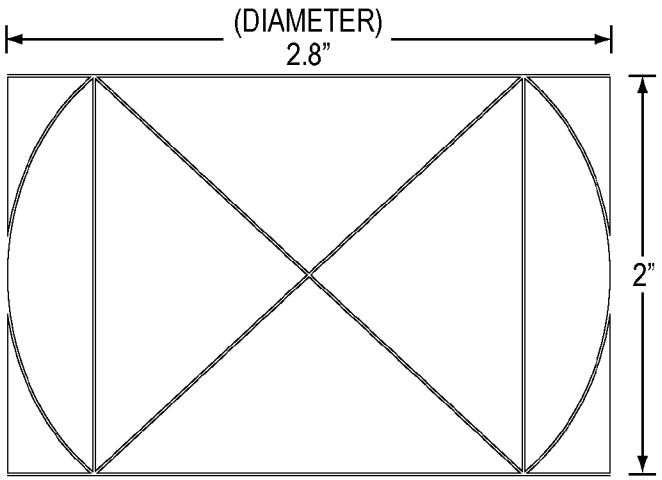
FIGS. 5A and 5B are a more detailed view of a single HIGH cube element.
Figure 5A:
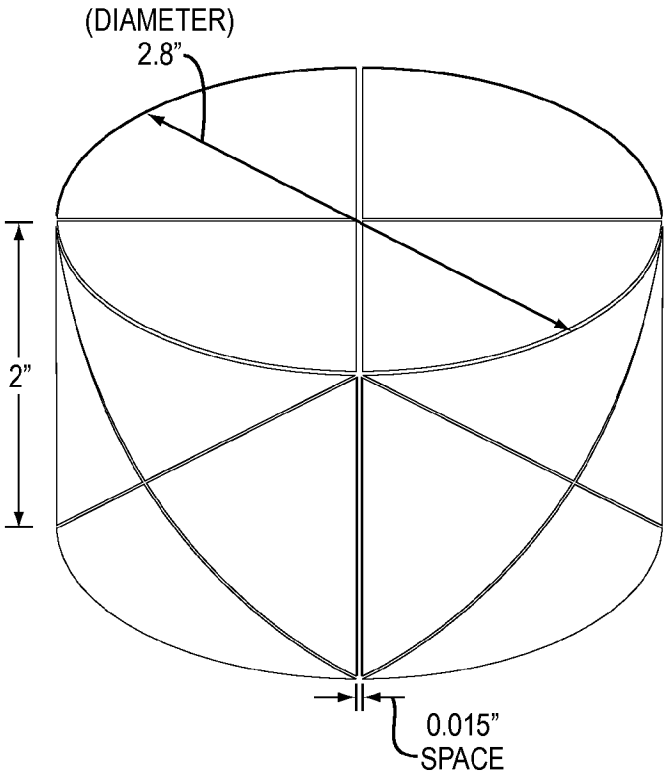

As briefly mentioned above, it is possible that the "cube" actually takes a cylindrical form factor, as shown in FIGS. 5A and 5B. From the isometric three-dimensional view of FIG. 5A it is seen that the cylinder is divided into four quadrants. The four quadrants each then correspond to the sides 1, 2, 3, and 4 or faces of the cube of FIG. 1; each quadrant thus contains the four antenna elements to provide two vertically oriented elements and two horizontally oriented elements as previously described. The top surface of the cylinder can then further be divided into the four elements as shown.

FIG. 5B is a side view of the cylinder structure. In this form factor, the cylindrical structure with a 2.8 inch diameter is an equivalent replacement for the 2 inch cube structure shown in FIG. 1.

Figure 6C:
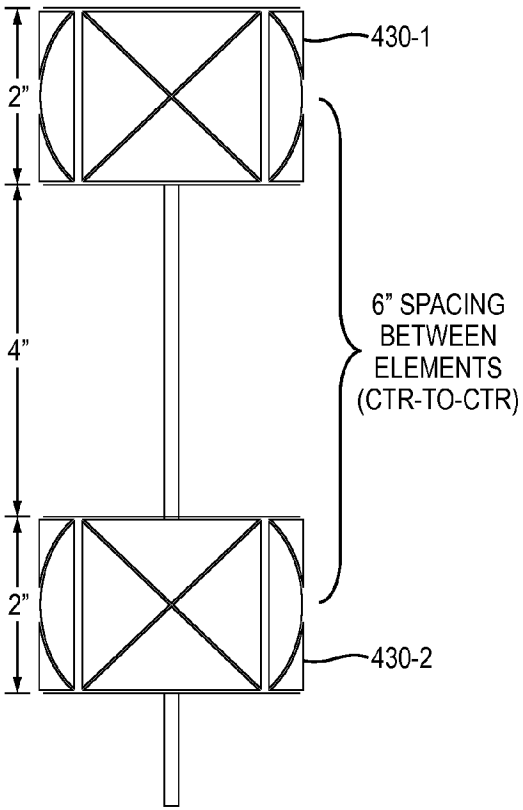
FIGS. 6A, 6B and 6C are a more detailed view of a two element HIGH cube implementation.
Figure 6B:
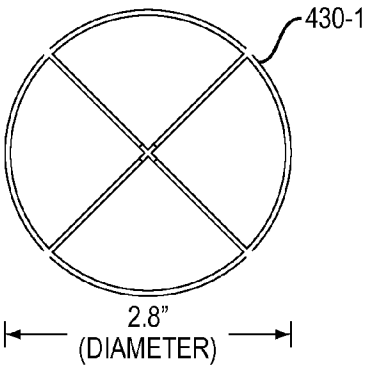
Figure 6A:
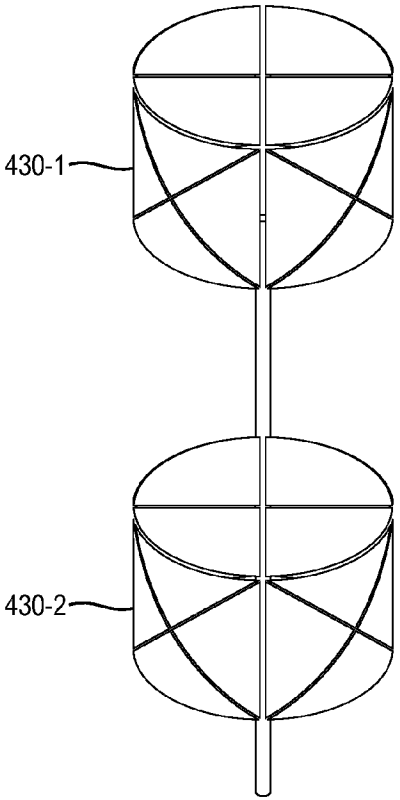

FIGS. 6A and 6B and 6C are more detailed views of the assembly of the HIGH cube cylindrical implementation showing a three-dimensional view, a top view, and side view, respectively. In preferred embodiments a total spacing of 6 inches is provided between the cylindrical elements from center to center with an approximate 4 inches between the bottom surface of the top element and the top surface of the bottom element.

Figure 7:
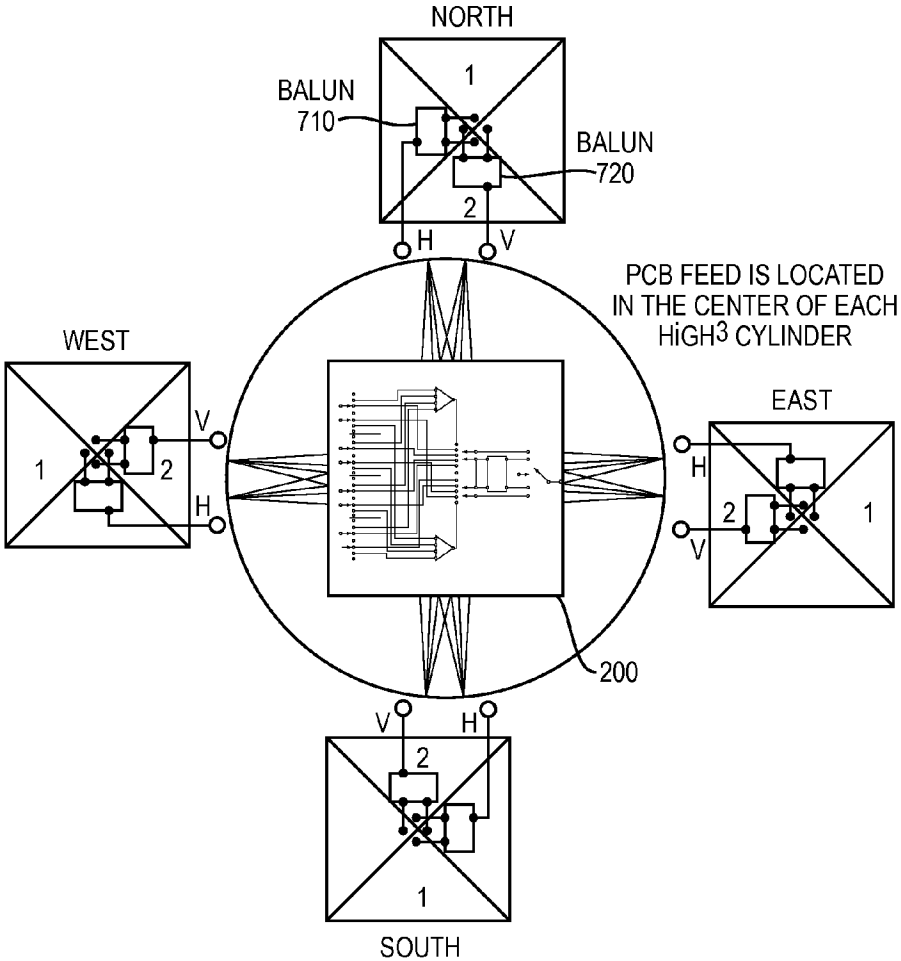
FIG. 7 illustrates feed connections to the basic four sided structure.

FIG. 7 illustrates how a feed structure is located in the center of each HIGH cube or cylinder. FIG. 7 is a schematic view showing the N,E,S,W sides of an example element and the interconnection of the feed. Thus, a given horizontal (H) coaxial feed is provided from a balun disposed between the two horizontal sections on a given face. Likewise, a vertical (V) coaxial feed is provided by a balun 720 disposed between two vertical segments on each face.

Figure 8B:
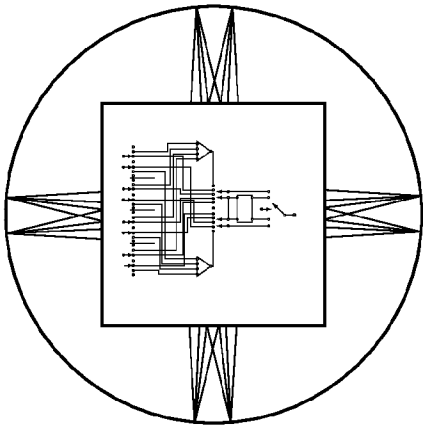
FIGS. 8A and 8B illustrate more detail of a printed circuit board (PCB) feed structure layout of a North, East, South and West side.
Figure 8A:
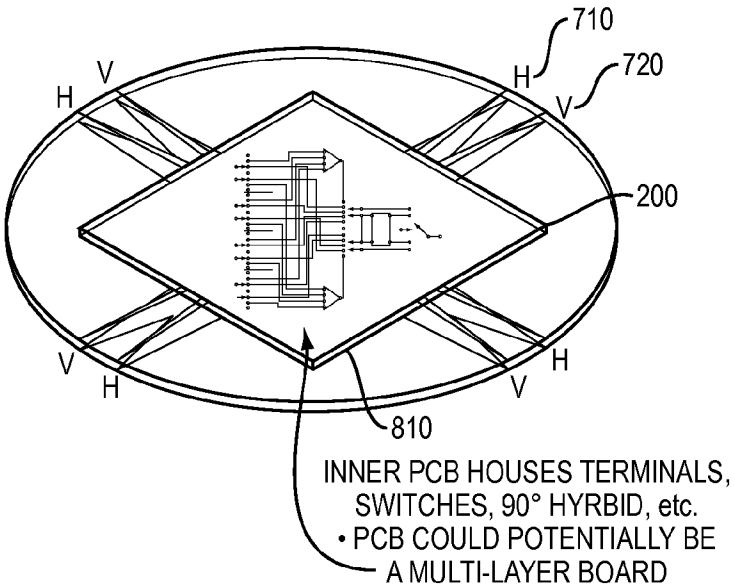

FIG. 7 is also suggestive of the preferred use of tapered baluns that are more particularly shown in FIGS. 8A and 8B. FIG. 8A shows a three-dimensional view and FIG. 8B a side view, respectively, of the tapered baluns and selector module 200. The selector module can be implemented on a circular form factor printed circuit board 810 that houses terminals, switches, 90° hybrid combiners and so forth as described in connection in more detail below. The printed circuit board 810 can be a multilayer circuit board. In the example shown there are eight tapered baluns 710, 720 disposed on each circuit board, one each for the vertical and horizontal feeds for each face of the sides of the cube or quadrant of the cylinder.

Figure 9:
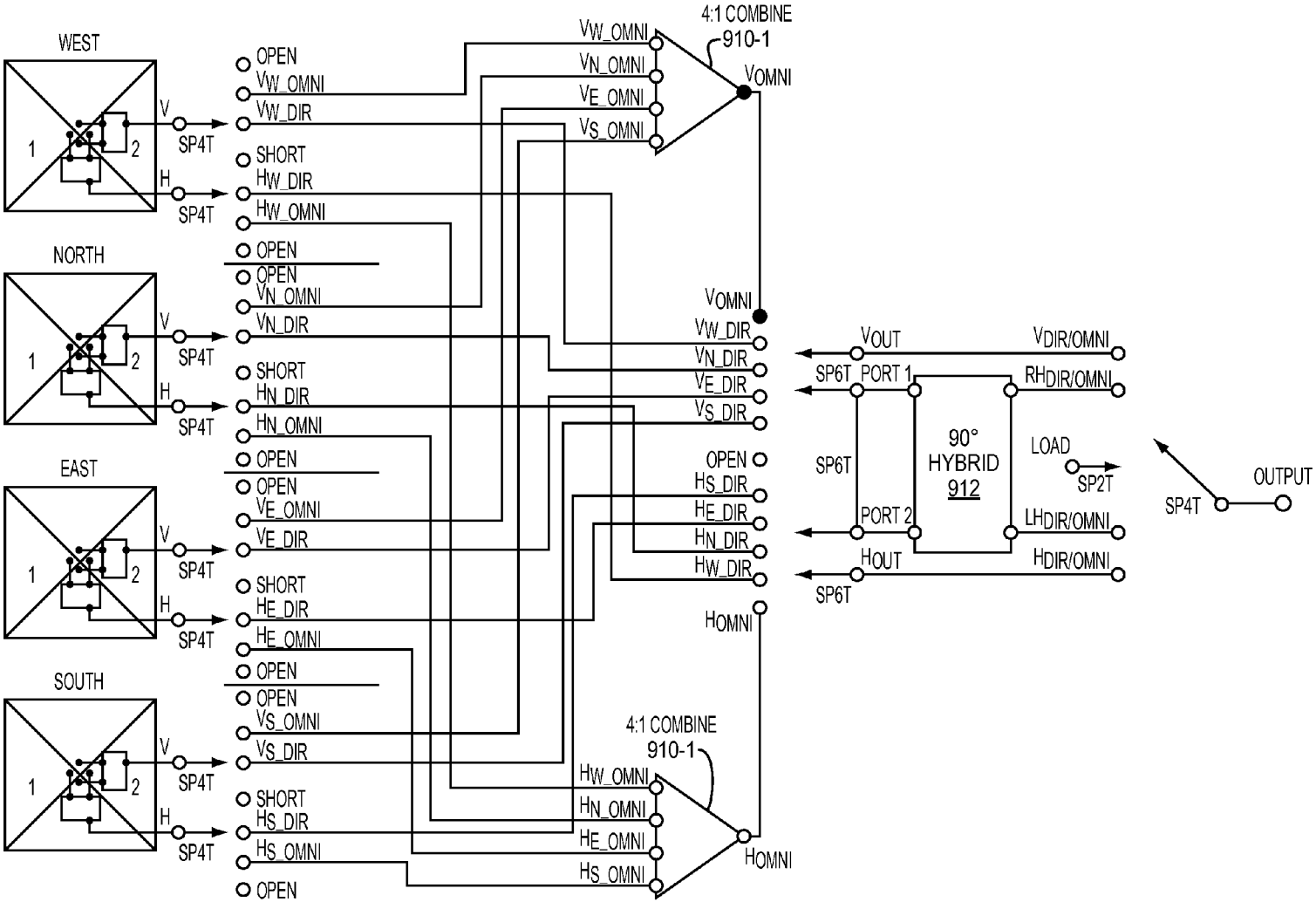
FIG. 9 is a circuit diagram of a switching scheme implementation.

FIG. 9 is a detailed circuit diagram showing the interconnection of the vertical and horizontal feeds from the N,E,S,W elements of a cube or cylinder. A Single Pole Four Throw (SP4T) switch associated with each of the feed points enables selection of an open, omnidirectional, directional, or short connection for respective feed points. These switch outputs are then fed to 4:1 combiners 910-1, 910-2 to provide vertical and horizontal omnidirectional modes, respectively. A 90° hybrid combiner 912 couples through a Single Pole Six Throw (SP6T) switch providing selection of the respective vertical omni or vertical directional mode for each of the N,E,S,W and directions or an open circuit. A similar connection is provided on another port (port 2) of the hybrid 912 from the horizontal oriented elements. By connecting the output to a Single Pole Two Throw (SP2T) switch, and feeding the vertical directional/omni, right-hand directional/omni, left-hand directional/omni and the horizontal directional/omni points, the outputs from these various modes can then be selectively activated.

Figure 10:
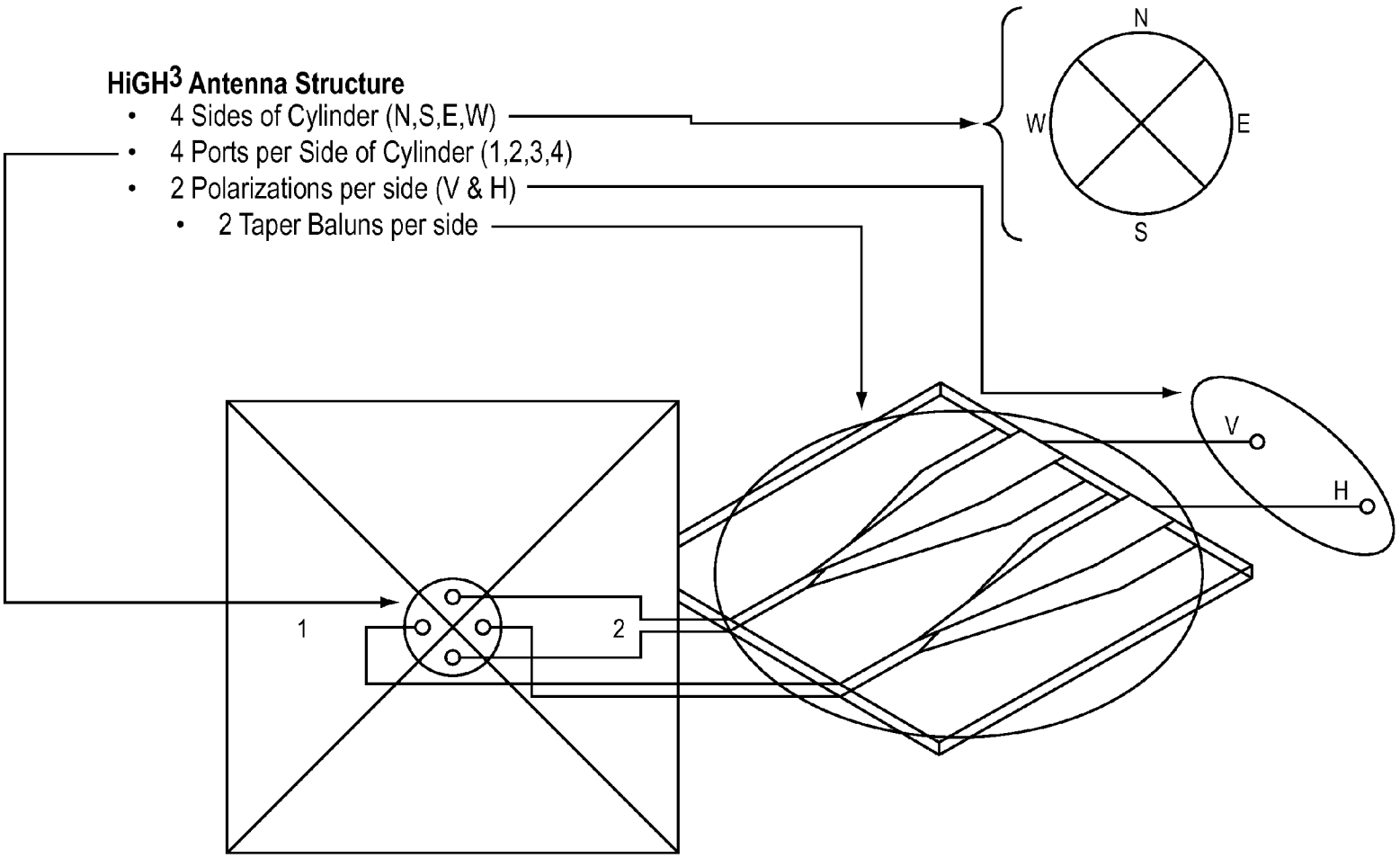
FIG. 10 illustrates a feed structure for an example single side.

FIG. 10 is a summary of the mechanical attributes of a HIGH cube antenna structure. These include providing four quadrants of a cylinder (N,E,S,W). Four ports for each quadrant of the cylinder provide two polarizations per side. (respectively vertical and horizontal), with two tapered baluns per side.

Figure 11:
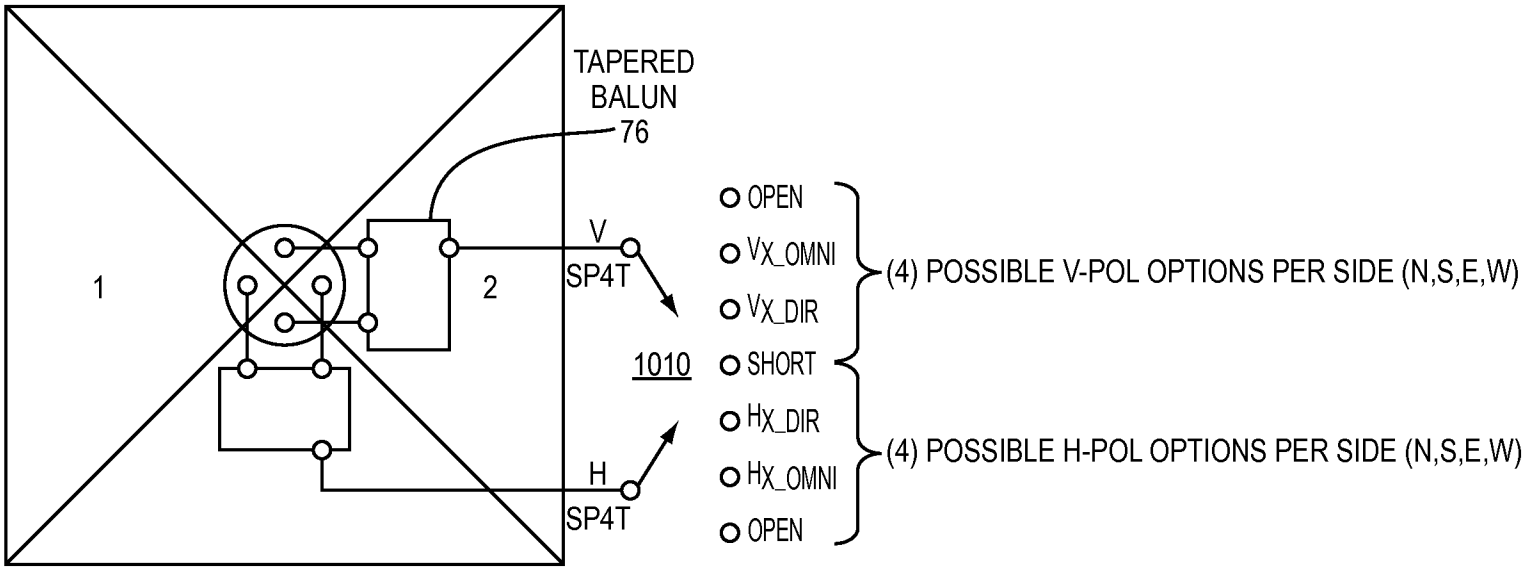
FIG. 11 illustrates more details of the feed structure for a single side.

FIG. 11 shows more detail of how a given side of the cube (or quadrant of the cylinder) provides a vertical and a horizontal feed point. Here, two ports, that is radiating triangular elements 3 and 4, feed into a tapered balun 710 to provide the vertical polarization output (V). SP4T switch 1010 thus provides multiple output options including open, vertical, omnidirectional, vertical directional, or short for each of the corresponding one of the available face directions (N,E,S,W).

Similar switching is provided to the horizontal feed point of the example side or quadrant where the two ports (that is, elements 1 and 2) feed into a tapered balun to provide the horizontally polarized output (H). The SP4T switch 1010 provides for options against open circuit, horizontal omni, horizontal directional, or short.

Figure 12:
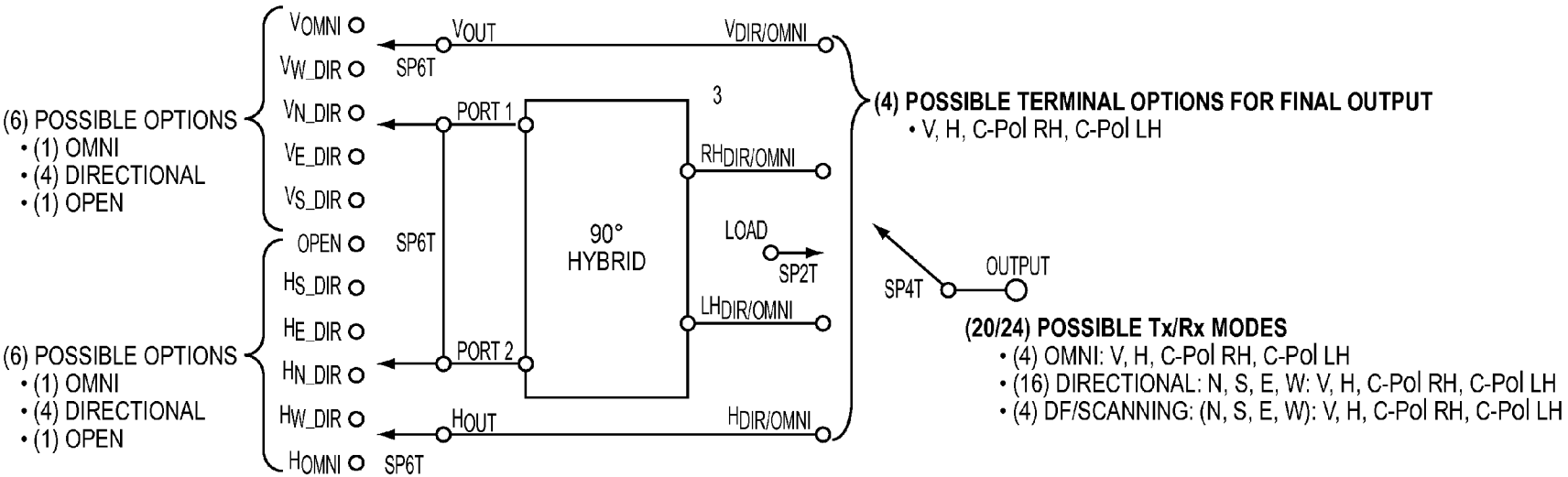
FIG. 12 illustrates the 90-degree hybrid switching scheme.

FIG. 12 shows the 90° hybrid combiner connections in more detail. Here the Vout terminal on the second leg is provided through a SP6T switch providing multiple options (vertical omni, vertical North South East or West, directional and open). The Hout terminal provides the corresponding six vertical polarized outputs. The second leg and its corresponding SP6T switch also has six corresponding options.

Many different propogation modes provide, for example twenty (20) transmit (Tx) and twenty-four (24) receive modes as follows:

Four (4) omni modes (Horizon)—for both transmit (Tx) and receive (Rx)

i. 512 MHz-6 GHz: vertical polarization (V-Pol)

ii. 1 GHz-6 GHz: C-Pol RH, C-Pol LH, H-Pol

Sixteen (16) Directional Modes—Tx/Rx i. 512 MHz-6 GHz: V-Pol: N, S, E, W ii. 1 GHz-6 GHz: C-Pol RH, C-Pol LH, H-Pol: N, S, E, W Four (4) Scanning/DF Mode—Rx Only i. 512 MHz-6 GHz: V-Pol (N, S, E, W)

ii. 1 GHz-6 GHz: C-Pol RH, C-Pol LH, H-Pol (N, S, E, W)

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. An antenna comprising:

a structure having sets of antenna elements generally facing in four different orthogonal directions, with each set of antenna elements including four radiating segments, at least two of the radiating segments providing a respective horizontal and vertical polarization;

a selector module situated within the structure, the selector module providing at least a horizontal and vertical polarization transmission line extending from corresponding horizontal and vertical polarization segments of the four sets of radiating elements; and a combining circuit connected to the transmission lines, to selectively enable a directional mode, omnidirectional mode, and polarization modes.

2. The antenna of claim 1 wherein the radiating segments are triangular in shape.

3. The antenna of claim 2 wherein the radiating segments of each set include two horizontally polarized triangular segments and two vertically polarized triangular segments.

4. The antenna of claim 1 wherein the structure is a six-sided structure.

5. The antenna of claim 1 wherein the structure is a cylinder.

6. The antenna of claim 1 wherein the combining circuit further provides vertical, horizontal, right-hand circular and left-hand circular polarization modes.

7. The antenna of claim 1 wherein the directional mode is selected by feeding a set of elements facing a desired direction of radiation and shortening transmission lines from the other three directions.

8. The antenna of claim 1 wherein a circular polarization mode is selected by feeding the horizontal and vertical elements of a set of elements with a quadrature hybrid combiner.

9. The antenna of claim 1 wherein the omnidirectional mode is provided by feeding all of the segments in phase with one another.

10. The antenna of claim 1 wherein the combining circuit is disposed in a middle portion of the structure.

11. The antenna of claim 10 wherein the combining circuit is disposed equidistant from the four sets of elements.

12. The antenna of claim 1 wherein the combining circuit is disposed in a middle portion of the structure.

13. An antenna comprising:

a first structure having sets of antenna elements generally facing in four different orthogonal directions, with each set of antenna elements including four radiating segments, at least two of the radiating segments providing a respective horizontal and vertical polarization;

a second structure having sets of antenna elements generally facing in four different orthogonal directions, with each set of antenna elements including four radiating segments, at least two of the radiating segments providing a respective horizontal and vertical polarization;

to a dipole antenna element; and the first and second structures and the dipole antenna element each coaxially disposed with respect to one another along a center axis.

14. The antenna of claim 13 additionally comprising:

a selector module situated within each of the first and second structures, the selector modules providing at least a horizontal and vertical polarization transmission line extending from corresponding horizontal and vertical polarization segments of the four sets of radiating elements of each structure.

15. An antenna comprising:

a structure having sets of antenna elements generally facing in four different orthogonal directions, with each set of antenna elements including four radiating segments, at least two of the radiating segments providing a respective horizontal and vertical polarization;

a selector module situated within the structure, the selector module providing at least a horizontal and vertical polarization transmission line extending from corresponding horizontal and vertical polarization segments of the four sets of radiating elements; and a combining circuit connected to the transmission lines.

16. The antenna of claim 15 wherein the combining circuit is disposed equidistant from the four sets of elements.

* * * * *

UNITED STATES PATENT AND TRADEMARK OFFICE

CERTIFICATE OF CORRECTION

PATENT NO. : 9,013,360 B1
APPLICATION NO. : 13/469222
DATED : April 21, 2015
INVENTOR(S) : John T. Apostolos et al.

It is certified that error appears in the above-identified patent and that said Letters Patent is hereby corrected as shown below:

In the Claims:
Claim 13, Col. 8, line 9 should read:
a dipole antenna element; and Signed and Sealed this
Eighth Day of September, 2015

Michelle K. Lee

Michelle K. Lee
*Director of the United States Patent and Trademark Office*